United States Patent [19]

Maw

[11] 4,065,880

[45] Jan. 3, 1978

[54] SHARPENER FOR CUT-OFF HAVING A HELICAL KNIFE

[75] Inventor: Philip Arthur Maw, London, England

[73] Assignee: Molins Limited, England

[21] Appl. No.: 694,320

[22] Filed: June 9, 1976

[30] Foreign Application Priority Data

June 14, 1975 United Kingdom ..... 25472/75

[51] Int. Cl.[2] ..... B24B 9/00

[52] U.S. Cl. ..... 51/247

[58] Field of Search ..... 51/246, 247

[56] References Cited

U.S. PATENT DOCUMENTS

| | | | |
|---|---|---|---|
| 2,022,569 | 11/1935 | Molins | 51/247 |
| 3,604,162 | 9/1971 | Preston | 51/247 |

*Primary Examiner*—Harold D. Whitehead

*Assistant Examiner*—Roscoe V. Parker

*Attorney, Agent, or Firm*—Craig & Antonelli

[57] ABSTRACT

A cut-off mechanism for a cigarette or other similar continuous rod making machine comprises a rotating helical knife and a sharpening device for sharpening the knife, characterized in that the sharpening device comprises two rotary sharpening members arranged to act on opposite sides of the knife, the sharpening members both being carried by a rotary member which rotates about an axis substantially parallel to the axes of rotation of the sharpening members, and each sharpening member being adjustable in regard to its distance from the axis of the rotary member, at least one of the sharpening members being driven by engagement of a rim on the sharpening member with an intermediate wheel which also engages a stationary ring which is coaxial with the rotary member.

12 Claims, 3 Drawing Figures

SHARPENER FOR CUT-OFF HAVING A HELICAL KNIFE

This invention concerns cut-off mechanisms for cigarette and other similar continuous rod making machines, including especially cigarette filter rod making machines. More particularly, this invention concerns sharpeners for helical knife cut-off devices. "Helical knife" refers to a knife shape which is part of a helix or whose shape approximates part of a helix, e.g. a short flat knife inclined to a plane normal to the axis of a rotation of a rotary body carrying the knife.

British patent specification No. 1,238,458 describes a cut-off mechanism for a continuous rod cigarette making machine using a helical knife. British patent specification No. 1,238,459 describes a frictional drive arrangement for the grinder which can be used for sharpening the helical knife of the device of British patent specification No. 1,238,458.

In these prior arrangements, the knife is sharpened by the grinder between successive cuts. That is, the knife is subjected to one sharpening operation for every cut it makes. The period of the sharpening cycle is thus the same as the period of the cutting cycle.

This invention is particularly concerned with a helical knife which is sharpened once every predetermined number of revolutions of the knife.

According to the present invention, a cut-off mechanism for a cigarette or other similar continuous rod making machines comprises a rotating helical knife and a sharpening device for sharpening the knife, characterised in that the sharpening device comprises two rotary sharpening members arranged to act on opposite sides of the knife, the sharpening members both being carried by a rotary member which rotates about an axis substantially parallel to the axes of rotation of the sharpening members, and each sharpening member being adjustable in regard to its distance from the axis of the rotary member, at least one of the sharpening members being driven by engagement of a rim on the sharpening member with an intermediate wheel which also engages a stationary ring which is coaxial with the rotary member.

One of the sharpening members may be what is commonly called a "deburrer." In other words it removes burrs or rough edges left by the action of the main sharpening member.

Other aspects of this invention will be clear from the appended claims and from the following description with reference to the accompanying drawings. In the drawings:

The arrangement shown is for use in connection with a twin-knife helical cut-off for a continuous rod cigarette making machine, the two knives being 180° apart on the rotary body carrying them. The sharpener is designed so that each knife is sharpened after every fifth cut. The arrangement would be basically the same for a device having a different number of knives, or in which the knives were sharpened more or less frequently; but the relative geometry and the gearing would be different.

Figure 1:
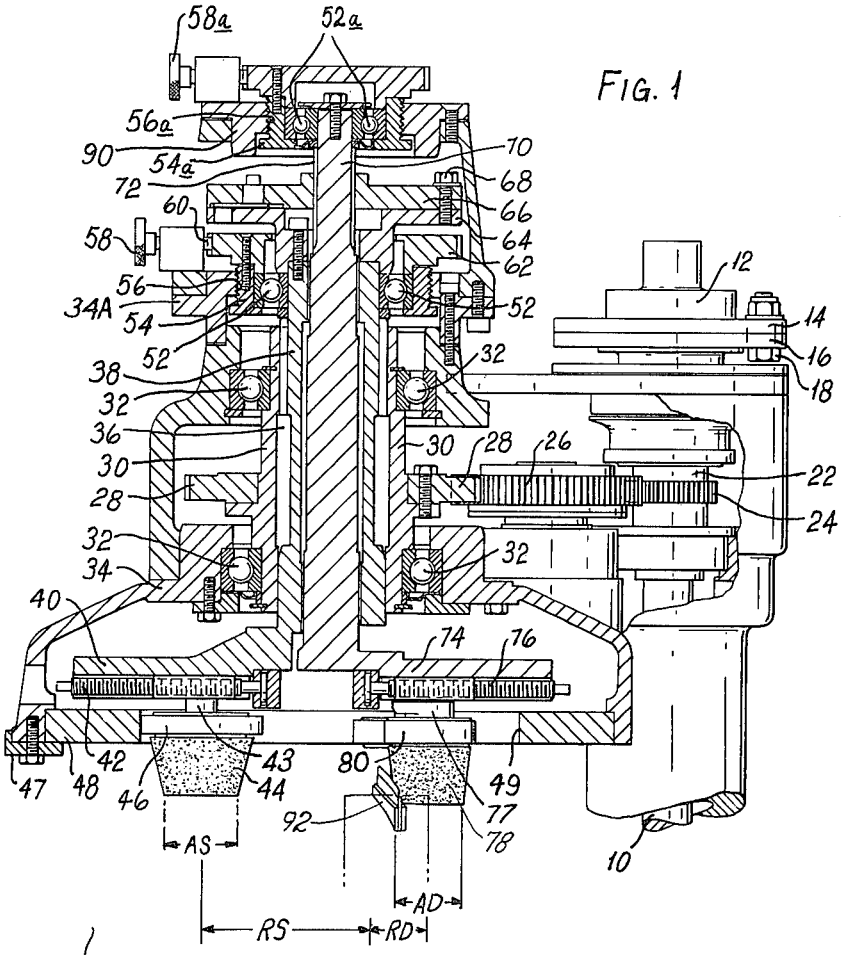
FIG. 1 is a diagrammatic side view, with some parts broken away and some parts in section, of an example of a sharpening mechanism according to this invention.

Referring now to FIG. 1, 10 is a shaft which is driven from the main drive of the machine at a speed of $\frac{2}{3}$ machine speed.

By "machine speed" is meant the number of cigarettes (for example) that is made in a unit of time. Thus, when it is said that the shaft 10 has a speed of $\frac{2}{3}$ machine speed, it will be understood that by this it is meant that the shaft 10 is driven at a speed of $\frac{2}{3}$ $a$ revolutions per minute, where $a$ is the number of cigarettes per minute which the machine is making.

Rigidly mounted on the shaft 10 is a boss 12 to which is fixed a disc 14. The disc 14 in turn is held in contact with another disc 16 by a pinch bolt 18. The disc 16 is mounted on a hollow shaft 22 which is concentric with the shaft 10. The shaft 22 carries a gear 24. The gear 24 meshes with an idler gear 26 which in turn drives a gear ring 28 mounted on a rotatable housing 30. The gears 24, 26 and 28 are arranged so that the housing 30 is rotated at a speed of 1/5 machine speed. The housing 30 journalled in bearings 32 carried by a static frame 34.

The interior of the housing 30 is formed with splines 36, and these engage with the outside of a hollow shaft 38 concentric with the housing 30. The shaft 38 is therefore driven at a speed of 1/5 machine speed.

The shaft 38 has a radical projection 40 at its lower end and this projection 40 carries a radially extending screw 42 which engages a part 43 on which a frustoconical sharpening stone 44 is mounted. The stone 44 therefore has an orbital speed of 1/5 machine speed, and its orbital radius RS can be adjusted by means of the screw 42, to suit different rod lengths.

The stone 44 is rotated about its own axis by frictional engagement between a drive rim 46, on the stone 44, and aring 48, mounted on the frame 34; the ring 48 has an inwardly facing driving surface 49. This way of driving the stone 44 is described in British patent specification No. 1,238,459. The ring 48 is held in place by a clamp plate 47. This facilitates changing the ring 48 for another ring of different internal diameter when a different length rod is to be cut, and thus a different orbital radius RS is required.

The hollow shaft 38 can be moved axially, thereby varying the height of the sharpener 44, as follows. The shaft 38 is carried, by means of bearings 52, in a ring 54 the outside of which is threaded. This thread engages with a thread 56 on the inside of the adjacent part 34A of the frame 34. Thus rotation of the ring 54 jacks the shaft 38 up or down. During use, the ring 54 is held against rotation by a latch 60 engaging in the notched periphery of a wheel 62 secured to the ring 54. The latch can be withdrawn, when necessary, by means of a knob 58.

The top end of the shaft 38 carries a flange 64. The flange 64 is in contact with a ring 66, and the flange 64 and the ring 66 are held into driving contact by a pinch bolt 68. The ring 66 is applied (by means of splines 72) onto a centre shaft 70 which is disposed inside, and concentric with, the hollow shaft 38. The shaft 70 is thus driven at the same speed as the hollow shaft 38, that is 1/5 machine speed.

The bottom end of the shaft 70 carries a radial arm 74 and this arm 74 has mounted in it a radially extending screw 76 which engages a part 77 carrying a frustoconical deburrer stone 78. The radial position of the deburrer stone 78 can therefore be adjusted by rotation of the screw 76, thereby altering the orbital radius RD of the deburrer stone 78. The deburrer stone orbits at the same speed as the sharpener stone 44, i.e. 1/5 machine speed.

Figure 2:
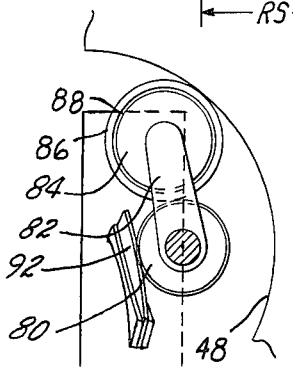
FIG. 2 is a schematic plan view of an arrangement for driving the deburrer stone of the sharpening mechanism of FIG. 1.
Figure 3:
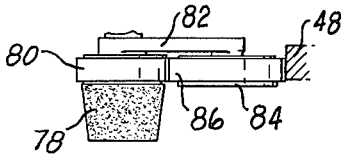
FIG. 3 is a side view of the driving arrangement of FIG. 2.

The deburrer stone 78, like the sharpener stone 44, is rotated about its own axis. However, since (as will be seen later) the orbital radius RD of the deburrer stone 78 is smaller than the orbital radius RS of the sharpener stone 44, the deburrer stone cannot be driven by direct frictional engagement with the ring 48. The drive arrangement for the deburrer stone 78 is shown in FIGS. 2 and 3.

The deburrer stone 78 has associated with it a drive rim 80. Pivoted about the axis of the stone 78 is one end of a swing link 82, and the other end of the swing link 82 carries an intermediate wheel 84. The intermediate wheel 84 is constructed like the drive rim 46 of the sharpener stone 44. That is, it has a hardened steel tyre 86 mounted on a deformable ring 88, such as a rubber O-ring.

When the deburrer stone 78 is rotated by the shaft 70, the swing link 82 swings outwards as a result of the centrifugal force acting on it, and the intermediate wheel 84 is therefore brought into frictional contact with the driving surface 49 and also with the rim 80. The deburrer stone 78 is therefore driven about its own axis by frictional drive from the ring 48 transmitted through the wheel 84.

The shaft 70 can be moved axially, thereby varying the height of the deburrer stone 78, in the same manner as the shaft 38. The shaft 70 is carried in bearings **52*a* and a surrounding ring 56*a* is in threaded engagement with a stationary part 90 surrounding it. Various other parts of the adjustment arrangement have been given the same reference numerals as the corresponding parts of the adjustment for the shaft 38**, but with the addition of a suffix *a*.

The phase of the sharpener stone 44 with respect to the shaft 10, and therefore with respect to the cut-off knife 92, can be adjusted by relative rotation of the discs 14 and 16. One, or both, of the discs 14 and 16 has an arcuate slot in it through which the pinch bolt 18 passes. The two discs can therefore be clamped together in different relative angular positions.

The phase between the sharpener stone 44 and the deburrer stone 78 can also be adjusted. This is done by varying the relative angular positions of the flange 64 and the ring 66. The flange 64 has a threaded hole into which the pinch bolt 68 screws, whereas the ring 66 has an arcuate slot through which the bolt 68 passes. Since the phase of the sharpener stone 44 relative to the cut-off knives is also adjustable, as described above, the phase of the deburrer stone 78 relative to the knives is dependent not only on the relative positions of the flange 64 and ring 66, but also on the relative positions of the rings 14 and 16.

In operation, the deburrer 78 leads the sharpener 44 by an angle $\phi$.

The angle $\phi$, the orbital radius RS of the sharpener stone 44 and the orbital radius RD of the deburrer stone 78 are all variables according to the rod length being cut. One possible set of values is given in the following table. The column headed RL is the rod length being cut; all the lengths are in millimeters.

| RL | RS | RD | $\phi$ |
|---|---|---|---|
| 45 | 51 | 43 | 153° |

-continued

| RL | RS | RD | $\phi$ |
|---|---|---|---|
| 70 | 73 | 58 | 173° |
| 90 | 86 | 71 | 185° |

The deburrer stone 78 has an included taper angle of 15° and a base diameter AD of 30 mm. This stone is suitable for use throughout the above range of rod length. However, the sharpener stone 44 is more sharply tapered, having an included angle of 30°, and it is necessary for different sizes of stone to be used for different rod lengths. The following table gives in the right hand column the base diameter AS of the stone suitable for use when cutting a rod length (RL) in the range shown in the same line in the left hand column. All dimensions are in millimeters.

| RL | AS |
|---|---|
| 45 - 52 | 38 |
| 53 - 60 | 36 |
| 61 - 67 | 34 |
| 68 - 75 | 32 |
| 76 - 82 | 30 |
| 83 - 90 | 28 |

As already mentioned, changes in the rod length also necessitate use of different rings 48 having different internal diameters since the driving rim 46 of the sharpener stone 44 is driven by direct contact with the ring 48. As an alternative however, the sharpener stone may be driven via an intermediate idler wheel, as in the case of the deburrer stone; in that case the same ring 48 may be used for various rod lengths.

It should be understood that the stones are rotated so that the knife or knives of the cut-off do not always engage the same part of the surface of the stones.

I claim:

1. A cut-off mechanism for a cigarette or other similar continuous rod making machine, comprising a rotating helical knife and a sharpening device for sharpening the knife, characterised in that the sharpening device comprises two rotary sharpening members arranged to act on opposite sides of the knife, the sharpening members both being carried by a rotary member which rotates about an axis substantially parallel to the axes of rotation of the sharpening members, and each sharpening member being adjustable in regard to its distance from the axis of rotary member, at least one of the sharpening members being driven by engagement of a rim on the sharpening member with a movable drive transmitting idler wheel which is mounted for rotation about an axis spaced from that of the said sharpening member and which also engages a stationary ring coaxial with the rotary member.

2. A mechanism according to claim 1 in which each of the sharpening members is adjustable in position by means of a radially extending screw.

3. A mechanism according to claim 1 in which the rotary member comprises two separate parts which are angularly adjustable relative to one another about their axis of rotation.

4. A mechanism according to claim 3 in which the two parts of the rotary member have portions which are clamped together by a bolt passing through an annular slot in at least one portion to allow the angular adjustment.

5. A mechanism according to claim 3 in which at least one of the parts of the rotary member is axially adjustable in position.

6. A mechanism according to claim 5 in which the axially adjustable part is mounted in a bearing which is in screw-threaded engagement with a fixed part so that the axial adjustment is achieved by rotation of the bearing.

7. A mechanism according to claim 1 in which the idler wheel is arranged to be urged into engagement between the rim and the stationary ring with at least the aid of centrifugal force.

8. A mechanism according to claim 7 in which the wheel is carried by a link which is arranged to pivot about the axis of the associated sharpening member.

9. A mechanism according to claim 1 in which the idler wheel includes a rigid outer annular member which is carried by an inner part via a deformable ring.

10. A mechanism according to claim 1 in which each of the sharpening members is frusto-conical in shape.

11. A mechanism according to claim 1 in which the rotary member is driven at a speed which is less than the machine speed and is arranged to sharpen the knife once every predetermined number of revolutions of the knife.

12. A cut-off mechanism for a cigarette or other similar continuous rod making machine, comprising a rotating helical knife rotating at a predetermined speed, and a sharpening device for sharpening the knife, characterised in that the sharpening device comprises a rotary member, means for driving the rotary member at a speed which is a submultiple of the speed of the knife whereby the knife is sharpened once during every predetermined number of revolutions, two rotary sharpening members mounted for rotation on the rotary member about axes spaced from and substantially parallel to the axis of rotation of the rotary member, each sharpening member being adjustable in regard to its distance from the axis of the rotary members, at least one of the sharpening members being driven by engagement of a rim on the sharpening member with a movable drive transmitting idler wheel which is mounted for rotation about an axis spaced from that of the said sharpening member and which also engages a stationary ring which is coaxial with the rotary member, being urged by centrifugal force during use into engagement between the ring and the rim of the sharpening member.

* * * * *